US012710032B2

(12) United States Patent
Huang et al.

(10) Patent No.: US 12,710,032 B2
(45) Date of Patent: Aug. 18, 2026

(54) MULTI-PRESSURE INTEGRATED AIR PUMP

(71) Applicant: Intex Marketing Ltd., Tortola (VG)

(72) Inventors: Zhi Xiong Huang, Fujian (CN); Ying Biao Zhang, Fujian (CN); Zheng Wen Lin, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 19/347,267

(22) Filed: Oct. 1, 2025

(65) Prior Publication Data

US 2026/0028973 A1 Jan. 29, 2026

Related U.S. Application Data

(63) Continuation of application No. 18/200,650, filed on May 23, 2023, now Pat. No. 12,448,958, which is a (Continued)

(30) Foreign Application Priority Data

Jul. 2, 2019 (CN) ..... 201921020161.1
Aug. 6, 2019 (CN) ..... 201921265055.X

(51) Int. Cl.
*F04B 23/14* (2006.01)
*F04B 13/00* (2006.01)
(Continued)

(52) U.S. Cl.
CPC ..... *F04B 23/14* (2013.01); *F04B 13/00* (2013.01); *F04B 23/06* (2013.01); *F04B 23/08* (2013.01);
(Continued)

(58) Field of Classification Search
CPC ..... F04B 23/14; F04B 13/00; F04B 23/06; F04B 23/08; F04B 23/106; F04B 35/06; F04B 41/06; F04D 13/068; F04D 13/12; F04D 17/16; F04D 19/046; F04D 25/0666; F04D 25/0673; F04D 25/084;
(Continued)

(56) References Cited

U.S. PATENT DOCUMENTS 5,584,669 A 12/1996 Becker
5,613,890 A 3/1997 Demars
(Continued)

FOREIGN PATENT DOCUMENTS

CN 201258841 Y 6/2009
CN 101846054 A 9/2010
(Continued)

OTHER PUBLICATIONS

European Search Report issued by the European Patent Office, dated Sep. 24, 2020, for EP Application No. 20183668; 11 pages.

*Primary Examiner* — Peter J Bertheaud
(74) *Attorney, Agent, or Firm* — Faegre Drinker Biddle & Reath LLP

(57) ABSTRACT

A high and low-pressure integrated air pump includes a single housing including an air inlet and an air outlet. A high-pressure pump is disposed within the housing and in fluid communication with the air inlet, and uses a first outlet passage to discharge to the air outlet. A low-pressure pump is also disposed within the housing and in fluid communication with the air inlet, and uses a second outlet passage to discharge to the air outlet.

19 Claims, 9 Drawing Sheets

Related U.S. Application Data continuation of application No. 16/914,895, filed on Jun. 29, 2020, now Pat. No. 11,686,299.

(51) Int. Cl.

| | |
|---|---|
| ***F04B 23/06*** | (2006.01) |
| ***F04B 23/08*** | (2006.01) |
| ***F04B 23/10*** | (2006.01) |
| ***F04B 35/06*** | (2006.01) |
| ***F04B 41/06*** | (2006.01) |
| ***F04D 13/06*** | (2006.01) |
| ***F04D 13/12*** | (2006.01) |
| ***F04D 17/16*** | (2006.01) |
| ***F04D 19/04*** | (2006.01) |
| ***F04D 25/06*** | (2006.01) |
| ***F04D 25/08*** | (2006.01) |
| ***F04D 25/16*** | (2006.01) |
| ***F04D 27/00*** | (2006.01) |
| ***F04D 29/42*** | (2006.01) |
| ***F04D 29/50*** | (2006.01) |

(52) U.S. Cl.

CPC ..... *F04B 23/106* (2013.01); *F04B 35/06* (2013.01); *F04B 41/06* (2013.01); *F04D 13/068* (2013.01); *F04D 13/12* (2013.01); *F04D 17/16* (2013.01); *F04D 19/046* (2013.01); *F04D 25/0666* (2013.01); *F04D 25/0673* (2013.01); *F04D 25/084* (2013.01); *F04D 25/16* (2013.01); *F04D 25/166* (2013.01); *F04D 27/005* (2013.01); *F04D 27/008* (2013.01); *F04D 29/4206* (2013.01); *F04D 29/503* (2013.01)

(58) Field of Classification Search

CPC ..... F04D 25/16; F04D 25/166; F04D 27/005; F04D 27/008; F04D 29/4206; F04D 29/503

See application file for complete search history.

(56) References Cited

U.S. PATENT DOCUMENTS

| | | | |
|---|---|---|---|
| 6,468,047 | B1 | 10/2002 | Huang et al. |
| 6,623,249 | B1 | 9/2003 | Rogers et al. |
| 7,670,119 | B2 | 3/2010 | Durand et al. |
| 8,151,390 | B2 | 4/2012 | Wang et al. |
| 8,393,873 | B2 | 3/2013 | Hill et al. |
| 8,496,449 | B2 | 7/2013 | Knuth et al. |
| 8,863,771 | B2 | 10/2014 | Wang et al. |
| 9,062,668 | B2 | 6/2015 | Wang et al. |
| 9,211,019 | B2 | 12/2015 | Driscoll et al. |
| 9,371,837 | B2 | 6/2016 | Tsai |
| 9,541,096 | B2 | 1/2017 | Tsai |
| 9,868,420 | B2 | 1/2018 | Chou |
| 9,879,682 | B1 | 1/2018 | Beliveau et al. |
| 10,502,218 | B2 | 12/2019 | Liu |
| 10,808,710 | B2 | 10/2020 | Huang et al. |
| 10,851,795 | B2 | 12/2020 | Lin et al. |
| 10,863,831 | B2 | 12/2020 | Ocegueda et al. |
| 11,084,339 | B2 | 8/2021 | Neir et al. |
| 11,268,529 | B2 | 3/2022 | Huang et al. |
| 11,384,769 | B2 | 7/2022 | Huang et al. |
| 11,401,926 | B2 | 8/2022 | Huang et al. |
| 11,668,310 | B2 | 6/2023 | Huang et al. |
| 11,668,312 | B2 | 6/2023 | Huang et al. |
| 11,686,299 | B2 | 6/2023 | Huang et al. |
| 11,703,059 | B2 | 7/2023 | Huang et al. |
| 11,896,139 | B2 | 2/2024 | Palashewski et al. |
| 2009/0169401 | A1 | 7/2009 | Digman |
| 2015/0316067 | A1 | 11/2015 | Tsai |
| 2017/0280884 | A1 | 10/2017 | Liu |
| 2018/0187687 | A1 | 7/2018 | Yakubova et al. |
| 2020/0049156 | A1 | 2/2020 | Lau et al. |
| 2021/0003120 | A1 | 1/2021 | Zhang et al. |
| 2023/0332587 | A1 | 10/2023 | Huang et al. |

FOREIGN PATENT DOCUMENTS

| | | | |
|---|---|---|---|
| CN | 201568328 | U | 9/2010 |
| CN | 103615402 | A | 3/2014 |
| CN | 103790848 | A | 5/2014 |
| CN | 203702506 | U | 7/2014 |
| CN | 204082603 | U | 1/2015 |
| CN | 108087231 | A | 5/2018 |
| CN | 208294737 | U | 12/2018 |
| DE | 202014100140 | U1 | 4/2014 |
| DE | 202014102361 | U1 | 10/2014 |
| DE | 202014102362 | U1 | 10/2014 |
| DE | 102014100330 | A1 | 7/2015 |
| KR | 10-1501151 | B1 | 3/2015 |

MULTI-PRESSURE INTEGRATED AIR PUMP

CROSS-REFERENCE TO RELATED APPLICATIONS

The present application is a continuation of U.S. patent application Ser. No. 18/200,650, filed May 23, 2023, which is a continuation of U.S. patent application Ser. No. 16/914,895, filed Jun. 29, 2020, now U.S. Pat. No. 11,686,299, which claims priority to Chinese Application No. CN_201921020161.1, filed Jul. 2, 2019 and to Chinese Application No. CN 201921265055.X, filed Aug. 6, 2019, both entitled A HIGH AND LOW PRESSURE INTEGRATED AIR PUMP, the entire disclosures of which are hereby expressly incorporated by reference herein.

BACKGROUND

1. Technical Field

The present disclosure relates to an inflation device, and in particular, to an air pump having a low-pressure pump and a high-pressure pump.

2. Description of the Related Art

Inflatable products, such as inflatable beds, inflatable rubber boats, balls, etc., may require an air pump to inflate. Air pumps are generally divided into high-pressure pumps (either internal or external) and low-pressure pumps (either internal or external).

The air pressure required to fully inflate different inflatable products is not uniform. For example, the internal pressure of ball products is relatively high, and the internal pressure of inflatable beds, or inflatable rubber boats, is relatively low. Low-pressure products cannot generally be safely inflated with high-pressure air pumps; and high-pressure products cannot generally be fully inflated with low-pressure air pumps. This may cause inefficiencies, such as by forcing a pump user to purchase and maintain two pumps, one for low-pressure inflatable products, and one for high-pressure inflatable products. This increase in price and decrease in portability brings inconvenience, especially in some circumstances such as during recreational trips.

In addition, many inflatable products are large when inflated, and must be completely deflated for storage. Upon inflation, these products require a pump that will work to supply air from 0 mm WC to the optimal pressures required for specific inflatable products, which can be above 180 mm WC for some products. However, most high-pressure air pumps operate at very poor efficiencies at low pressures. On the other hand, low pressure pumps cannot reach the high pressure needed by some inflatable products such as a basketball. To overcome this deficiency, more power and design must be put into pumps. This, in turn greatly increases the cost of manufacturing and powering these electric pumps.

What is needed is an improvement over the foregoing.

SUMMARY

The present disclosure provides a high and low-pressure integrated air pump. The pump includes a single housing including an air inlet and an air outlet. A high-pressure pump is disposed within the housing and in fluid communication with the air inlet, and uses a first outlet passage to discharge to the air outlet. A low-pressure pump is also disposed within the housing and in fluid communication with the air inlet, and uses a second outlet passage to discharge to the air outlet.

In one form thereof, the present disclosure provides a high and low-pressure integrated air pump, including a housing including an air inlet and an air outlet, a high-pressure pump disposed within the housing, in fluid communication with the air inlet and in fluid communication with the air outlet via a first outlet passage, and a low-pressure pump disposed within the housing, in fluid communication with the air inlet and in fluid communication with the air outlet via a second outlet passage.

In another form thereof, the present disclosure provides a high and low-pressure integrated air pump, including a housing including an air inlet and an air outlet, a high-pressure pump disposed within the housing in fluid communication with the air inlet and the air outlet, a low-pressure pump disposed within the housing and in fluid communication with the air inlet and the air outlet, a pressure valve disposed between the low-pressure pump and the air outlet, and a control circuit in electrical communication with the pressure valve and configured to control the high-pressure pump and the low-pressure pump in response to signals from the pressure valve.

In yet another form thereof, the present disclosure provides a high and low-pressure integrated air pump, including a housing including an air inlet and an air outlet, a high-pressure pump disposed within the housing in fluid communication with the air inlet and the air outlet, a first high-pressure check valve separating the high-pressure pump from the air inlet, a low-pressure pump disposed within the housing and in fluid communication with the air inlet and the air outlet, a first low-pressure check valve separating the low-pressure pump from the air inlet, and a second check valve separating the high-pressure pump from the low-pressure pump.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the disclosure in any manner.

DETAILED DESCRIPTION

Figure 1:
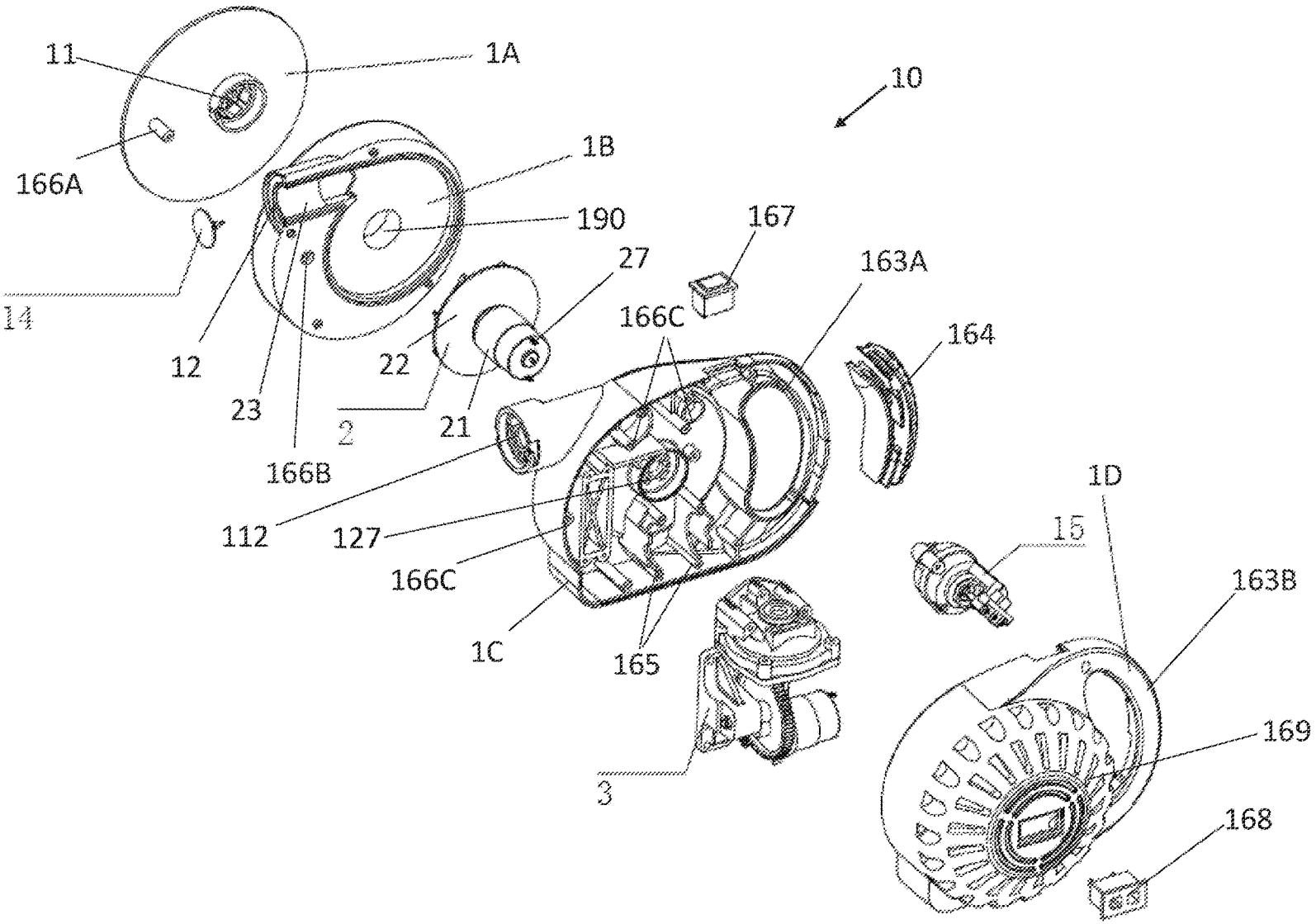
FIG. 1 is a perspective, exploded view of a high and low-pressure integrated air pump in accordance with a first embodiment of the present disclosure.

Referring to FIG. 1, the present disclosure provides a high and low-pressure integrated air pump 10, which includes a housing 1, a low-pressure pump assembly 2, a high-pressure pump assembly 3, a pressure valve 15, and a controller 150 (FIG. 7) programmed to activate and deactivate the high-pressure pump 3 and the low-pressure pump 2 according to a predetermined logic, as further described in detail below.

Housing 1 is an assembly of components including left housing cap 1A, left housing 1B, right housing 1C, and right housing cap 1D. In the illustrative embodiment of FIG. 1, left housing cap 1A is a round plate which includes a fastener standoff 166A and air inlet 11 passing through the plate. Fastener standoff 166A extends laterally inwardly from left housing cap 1A and may inserted into left housing 1B and fastened thereto.

Air inlet 11 is a round aperture which is configured to allow air to be drawn in by pump assemblies 2 or 3. In an exemplary embodiment, air inlet 11 includes a debris guard on an outer surface of left housing cap 1A which prevents debris from being sucked into and potentially damaging pumps 2 or 3. Air inlet 10 extends laterally inward from left housing cap 1A to sealingly couple with air inlet path 190 of left housing 1B.

Still referring to FIG. 1, left housing 1B includes fastener aperture 166B, air outlet 12, air inlet path 190, and cavity 23, which is formed as curved interior space cooperating with right housing 1C to create a volute as further described below. Fastener aperture 166B receives fastener standoff 166A to couple left housing 1B to left housing cap 1A. Air outlet 12 is an air pathway that allows air that is pumped from either low-pressure pump 2, or high-pressure pump 3 to flow out of air pump 10, and into an inflatable product (not shown). Air inlet path 190 is a cylindrical bore which is aligned with air inlet 11 and provides a pathway from air inlet 11, into low-pressure pump 2, and high-pressure pump 3. Cavity 23 is formed as an inset of left housing 1B and houses low-pressure pump 2 as further described below.

Figure 5:
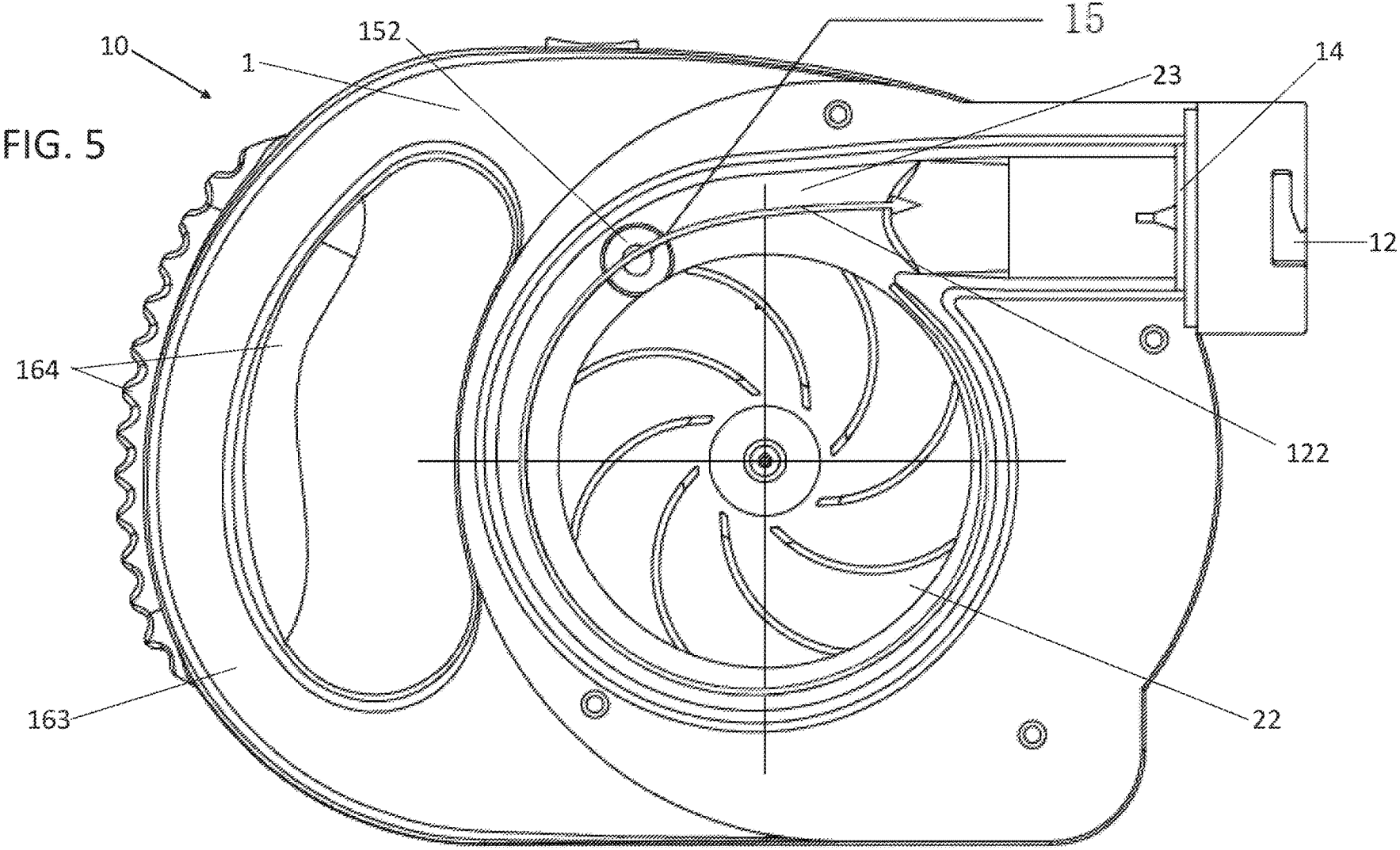
FIG. 5 is a partial, cross-sectional view of the low-pressure pump shown in FIG. 2.

As shown in FIG. 1, right housing 1C includes handle portion 163A, handle cover 164, first motor retainer 127, fastener standoffs 166C, brackets 165, and switch 167. Handle portion 163A is an extension from right housing 1C that couples to a similarly shaped handle portion 163B of right housing cap 1D to form handle 163 (FIG. 5). Handle 163 is sized and configured to allow a user to grasp and retain air pump 10. As shown in FIG. 5, handle cover 164 attaches to handle 163 and provides both interior and exterior grasping surfaces for the ergonomic comfort of a user.

Referring again to FIG. 1, first motor retainer 127 is formed as a bore through housing 1C, and is positioned to align with air inlet path 190 and air inlet 11. First motor retainer 127 provides a mounting seat for low-pressure pump 2 and provides an airflow path from air inlet 11, to high-pressure pump assembly 3.

Fastener standoffs 166C provide attachment points for right housing 1C to be coupled to right housing cap 1D and left housing 1B. Brackets 165 are formed within right housing 1C and cooperate with similarly formed brackets in right housing cap 1D to create an indentation sized to receive portions of high-pressure pump 3, such that pump 3 is retained and protected within housing 1 during transport, storage and operation. Brackets 165 may also include fastener apertures to allow for more coupling points between right housing 1C and the other portions of housing 1.

Right housing 1C also includes switch 167. Switch 167 is a multi-position manual microswitch mounted to the exterior of housing 1 and positioned to be engaged by a user of air pump 10. Switch 167 could be any other suitable switch design as required or desired for a particular application. Switch 167 activates or deactivates air pump 10 into ON and OFF modes and also toggles low-pressure pump 2 or high-pressure pump 3 as further described below.

Still referring to FIG. 1, right housing cap 1D includes handle portion 163B, exhaust 169, and fuse 168. As noted above, handle portion 163B couples to handle portion 163A of right housing 1C to form handle 163 (FIG. 5) when housing 1 is assembled. In the illustrative embodiment of FIG. 1, cooling apertures 169 are constructed as a series or array of apertures passing through right housing cap 1D. Cooling apertures 169 are configured to allow air to flow freely between the interior housing 1 and the ambient environment to cool high-pressure pump 3 and low-pressure pump 2 during operation.

Figure 4:
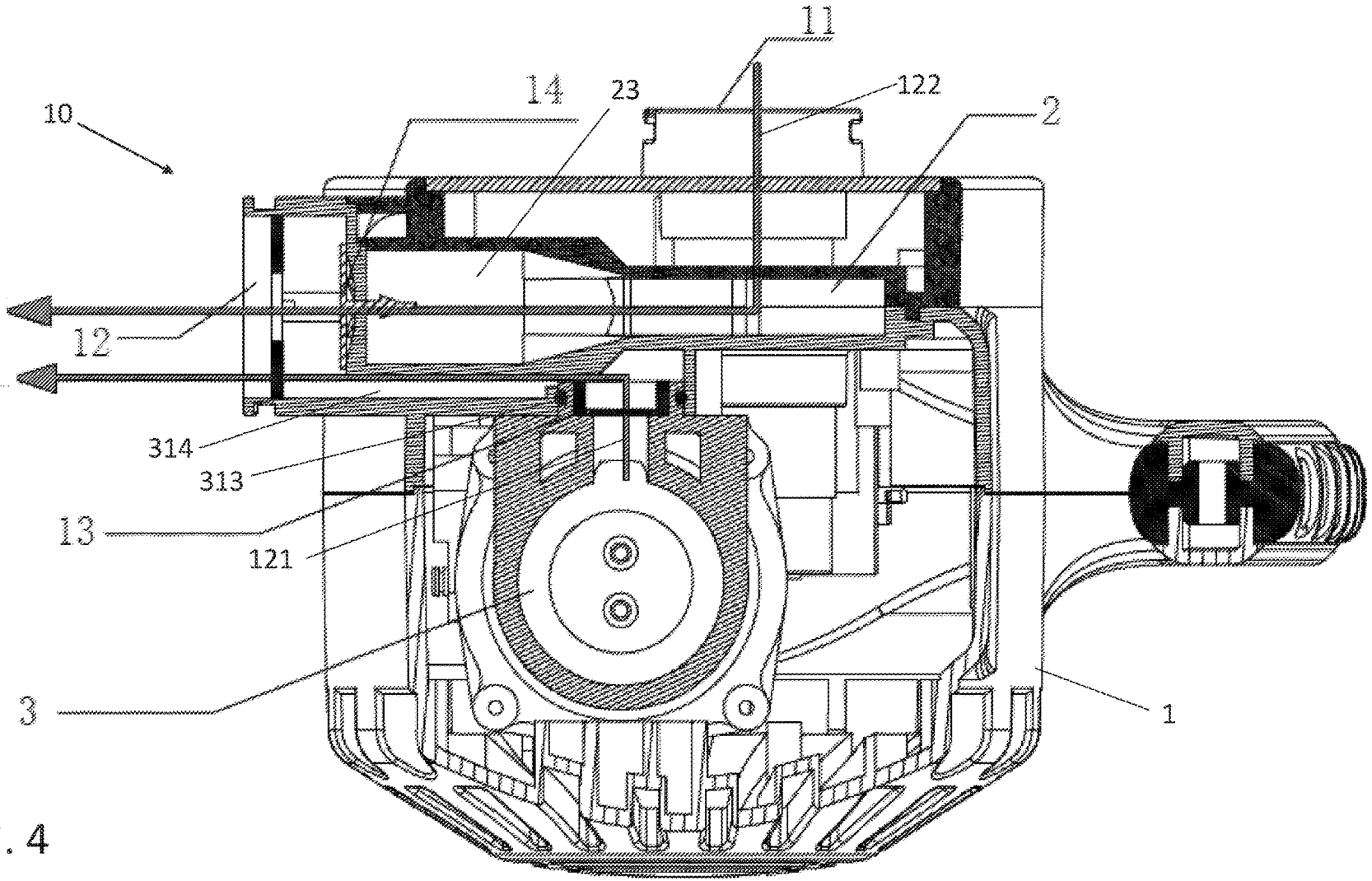
FIG. 4 is a partial, cross-sectional view of the high and low-pressure integrated air pump shown in FIG. 1.

Upon assembly and as shown in FIGS. 4 and 5, left housing cap 1A, left housing 1B, right housing 1C, and left housing cap 1D are assembled to one another and fixed in place to form the assembled housing 1. Housing 1 contains and supports low-pressure pump 2 and high-pressure pump 3, and defines air inlet 11 and air outlet 12, which are in fluid communication with both low-pressure pump 2 and high-pressure pump 3 as further described below.

Figure 2:
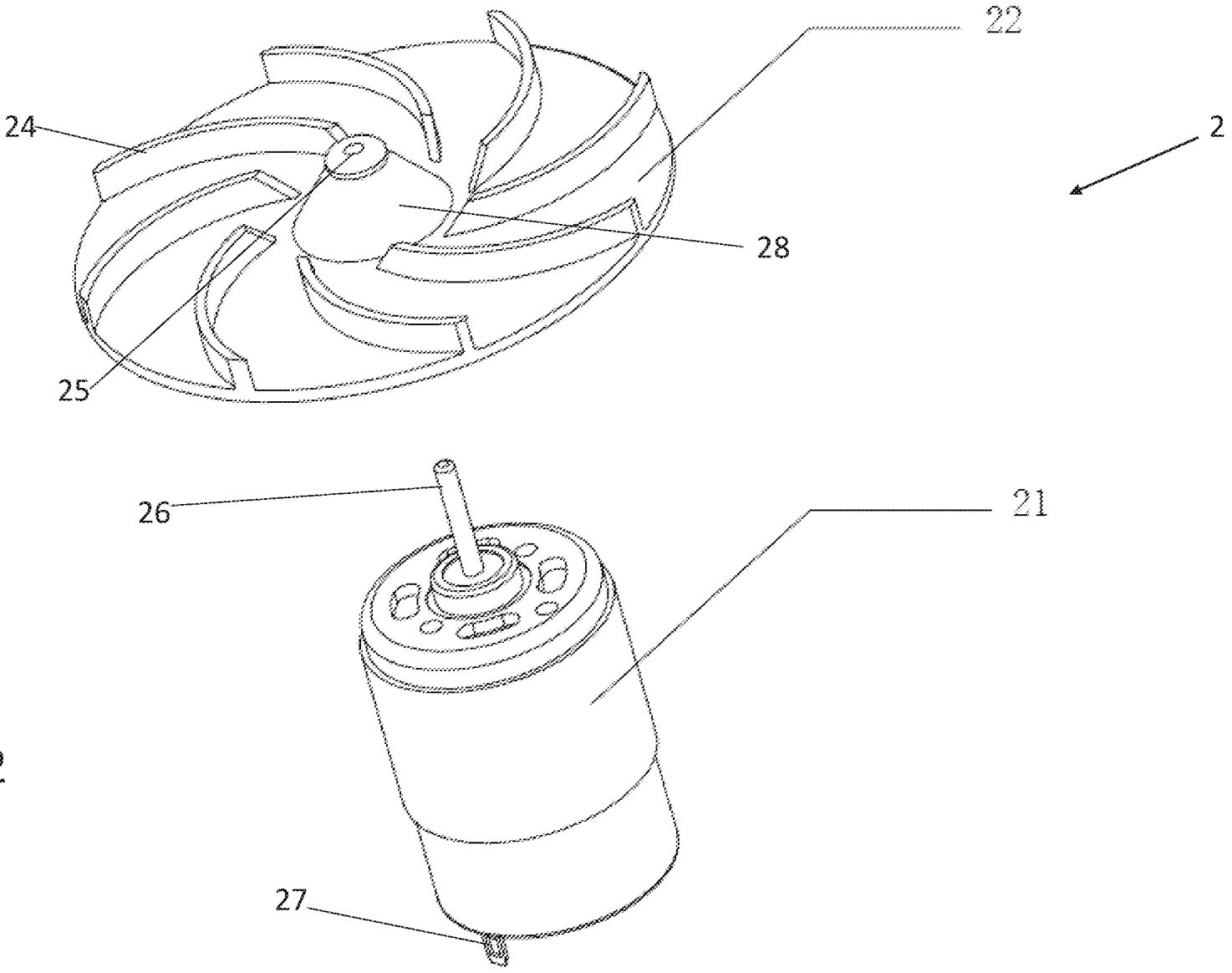
FIG. 2 is a perspective, exploded view of a portion of the high and low-pressure integrated air pump shown in FIG. 1, showing a low-pressure pump.

Turning to FIGS. 1 and 2, low-pressure pump assembly 2 includes first motor 21, impeller 22, and volute 23. As shown in FIG. 2, first motor 21 is an electric motor with a generally cylindrical motor body (including a stator and rotor contained therein) and a drive shaft 26 powered by the motor 21. Motor 21 also includes motor clips 27 which engage with a portion of first motor retainer 127 to mount first motor 21 to housing 1. When activated, drive shaft 26 of motor 21 rotates under power such that drive shaft 26, which is drivingly coupled to impeller 22, drives the rotation of impeller 22 to accelerate air outwardly. This acceleration draws air in through inlet 11, and pump out through air outlet 12. When pump 10 is connected to an inflatable product, this activation inflates the product.

Referring to FIG. 2, impeller 22 is a circular impeller with columns 24 extending radially outwardly from impeller 22 and fanning out. Columns 24 create air channels which pressurize air during operation to drive air through air outlet 12. Impeller 22 also includes central hub 28. Hub 28 is a conical structure extending axially from the center of impeller 22. Hub 28 aligns with and extends partially into air inlet 11. The conical shape of hub 28 guides air flowing into low-pressure pump 2 radially out and into columns 24. Within hub 28 is drive shaft aperture 25 which receives drive shaft 26 and allows impeller 22 to be rotatably driven by motor 21.

Turning again to FIG. 1 volute is shown as a space sized to receive impeller 22. As impeller 22 rotates, air is pressurized and driven out of air outlet 12. The downstream portion of volute 23 acts as a low-pressure exhaust passageway which eventually extends into air outlet 12, as best shown in FIGS. 4 and 5. Set within this downstream portion of volute 23 is check valve 14. Check valve 14 operates to allow air to flow out of volute 23 and outlet 12, but to inhibit any "backflow" of air from outlet 12, back into volute 23. In this way, check valve 14 selectively fluidly isolates volute 23 from air outlet 12. As shown in FIGS. 4 and 5 low-pressure air flow pathway 122 is produced by this arrangement of low-pressure pump 2. Air is drawn into and pressurized within volute 23 by impeller 22 until the pressure is sufficient to activate check valve 14. When activated, the air flows outwardly from volute 23 to outlet 12, and into an inflatable product.

As shown in FIG. 1, air pump 10 includes high-pressure pump 3 in addition to low-pressure pump 2. A first embodiment of high-pressure pump 3, shown in FIG. 3, includes second motor 31, gear 32, connecting rod 33, diaphragm 34, and cavity 35. Second motor 31 may be an electric motor similar to first motor 21. Second motor includes motor clips 325 which are similar in shape and function to motor clips 27. Second motor also includes a powered output shaft having spur gear 39 mounted thereto. Spur gear 39 includes gear teeth that mesh with a larger spur gear 32. When motor 31 is activated, gear 32 is driven to rotate the opposite direction with a mechanical advantage.

Gear 32 includes axle bore 321 which is a throughbore at the center of gear 32. Received within axle bore 321 is axle 37. Axle 37 is a rod which is fixed within axle bore 321 at one end and rotatably received within gear base 36. Gear base 36 may be a bearing having a bearing housing fixed to a portion of housing 1 (e.g., by fasteners received in right housing 1C as shown in FIG. 1). Gear base 36 includes a throughbore within which axle 37 is rotatably fixed. Axle 37 is discouraged from sliding laterally out of the throughbore in gear base 36 by fasteners such as C-clips, the details of which will be discussed below with respect to C-clips 327. Axle 37 allows free rotation of gear 32 about its axis, and discourages gear 32 from any lateral or horizontal wobble during operation.

Figure 3:
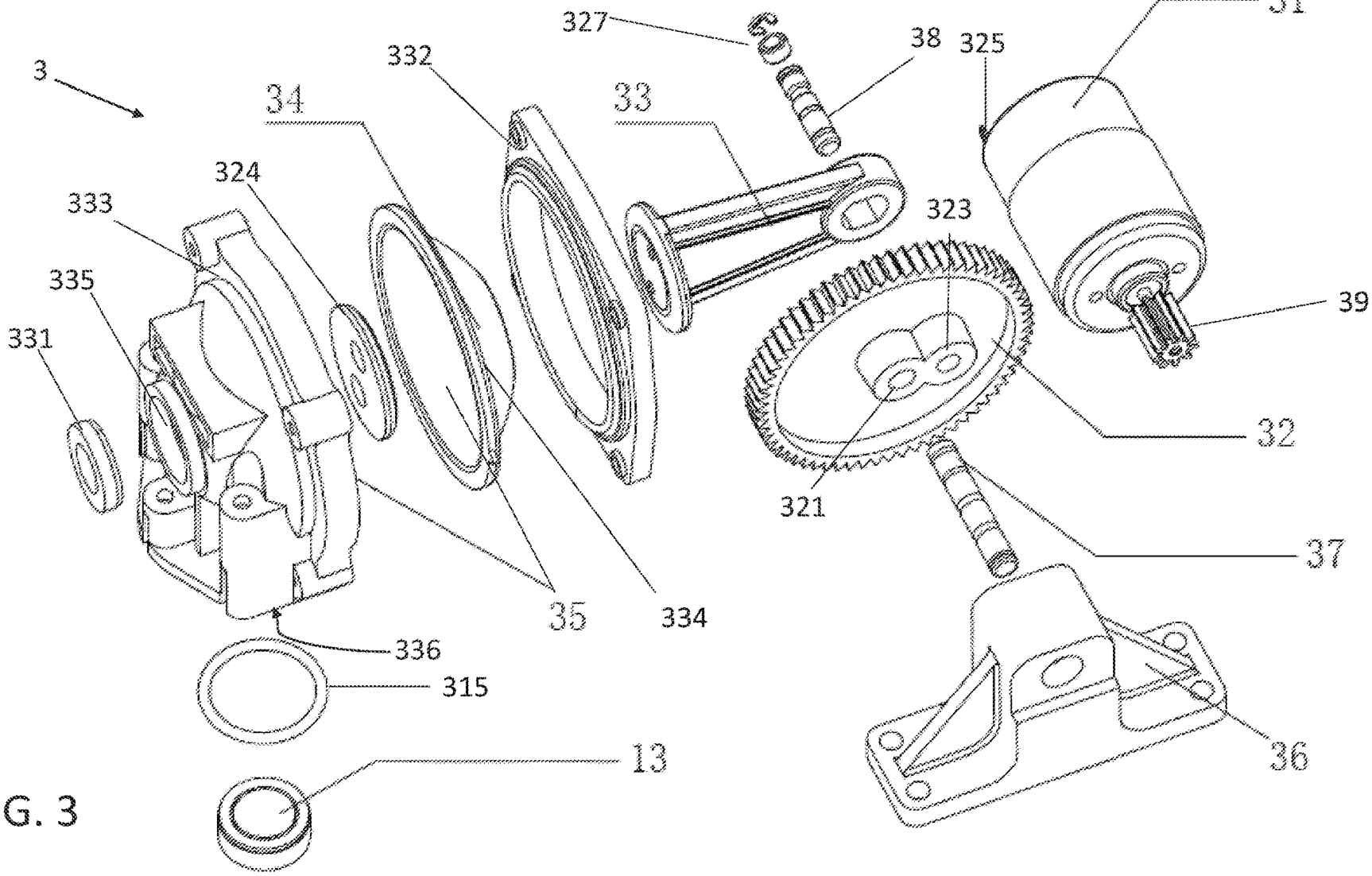
FIG. 3 is a perspective, exploded view of a portion of the high and low-pressure integrated air pump shown in FIG. 1, showing a high-pressure pump.

As best seen in FIG. 3, shaft aperture 323 is located adjacent axle bore 321 and positioned in an off-center location on gear 32. Shaft aperture 323 is another throughbore in gear 32 which rotatably receives rotating shaft 38. Rotating shaft 38 is a rod, similar to axle 37, which extends laterally out of rotating shaft aperture 323 and into connecting rod 33. In the illustrated embodiment, rotating shaft 38 extends through connecting rod 33 and is rotatably secured thereto by fastener clips 327. Clips 327 can be snap-fit C-clips which have a larger diameter than the throughbore of connecting rod 33 which rotating shaft 38 extends. Alternatively any other type of suitable method for rotatably coupling shaft 38 to connecting rod 33 may be used.

As gear 39 is driven by second motor 31, gear 32 rotates about axle 37. This rotation causes connecting rod 33 to reciprocate with a forward and return stroke as rotating shaft aperture 323 rotates about the axis of axle bore 321. As further described in detail below, this reciprocation provides the motive force for high-pressure pump 3.

Still referring to FIG. 3, high-pressure pump 3 also includes diaphragm 34 coupled to connecting rod 33. Diaphragm 34 may be cup-shaped and is constructed of an flexible and durable material which is not air-permeable. Diaphragm 34 is coupled to connecting rod 33 by retention plate 324, which is a round flat plate placed on the inside of diaphragm 34 opposite connecting rod 33. Plate 324 includes fastener apertures such that fasteners can couple plate 324 to connecting rod 33, thereby capturing diaphragm 34 therebetween.

This coupling of the diaphragm 34 between plate 324 and connecting rod 33 allows diaphragm 34 to be resiliently deformed by the reciprocating motion of connecting rod 33. The periphery of diaphragm 34 is fixed relative to its center by a flanged outer circumference 334 which is fastened and retained between mid-frame 332 and end frame 333. In the illustrated embodiment, frames 332 and 333 are fixed to one another by bolts or screws (not shown) and thereby capture flanged outer circumference 334 therebetween.

End frame 333 includes a hemispherical cavity which faces diaphragm 34, and which combines with diaphragm 34 to form high-pressure pump cavity 35. Mid-frame 332 and end frame 333 hold diaphragm 34 in place such that as diaphragm 34 is pumped, pump cavity 35 is expanded and compressed repeatedly to pump air through high-pressure pump 3. End frame 333 also includes inlet 335 and outlet 336. Inlet 335 is fluidly connected to air inlet 11 and includes check valve 331. Check valve 331 operates to let air flow into pump cavity 35 during its expansion phase, but prevents or inhibits airflow from inside pump cavity 35 to air inlet 11 during the compression phase. Instead, the pressurized air from pump cavity 35 is expelled through outlet 12 as further described below.

Turning to FIGS. 3 and 4, outlet 336 (FIG. 3) is fluidly connected to air outlet 12 and includes check valve 13 and gasket 315. Gasket 315 is disposed around check valve 13 to sealingly connect check valve 13 to outlet 336. Check valve 13 operates to allow air to be pumped out of pump cavity 35 and into air outlet 12, and to prevent or inhibit airflow from air outlet 12 into pump cavity 35 during the expansion phase of pump cavity 35.

Thus, as shown in FIG. 4, high-pressure airflow pathway 121 through high-pressure pump 3 is established by the cooperation of diaphragm 34 and check valves 313, 331. Air is drawn into cavity 35 via inlet 11 and intake check valve 331 during the expansion phase, when diaphragm 34 is drawn away from end frame 333 by connecting rod 33. As connecting rod 33 changes direction and cavity 35 begins to contract, intake check valve 331 closes and exhaust check valve 313 opens. The pressurized air is then pumped through check valve 313 and into a high-pressure outlet passageway 314 (FIG. 4), where it is directed to the same outlet 12 which receives air from the low-pressure passageway at the outlet of volute 23 as described in detail above. This high-pressure air may then be discharged into an inflatable product, as also described above.

Moreover, high-pressure airflow pathway 121 and low-pressure airflow pathway 122 are respectively provided with check valves 13 and 14 to ensure separation of air flow from high-pressure pump 3 and from low-pressure pump 2 through a common air outlet 12. As described further below, pump 10 may be controlled such that only one of pathways 121, 122 is active at any one time. Check valves 13 and 14 are used to fluidly isolate the two airflow pathways 121 and 122, such that airflow along one of the pathways 121, 122 is directed only out through outlet 12, rather than into the other (inactive) pathway 121, 122.

Figure 8:
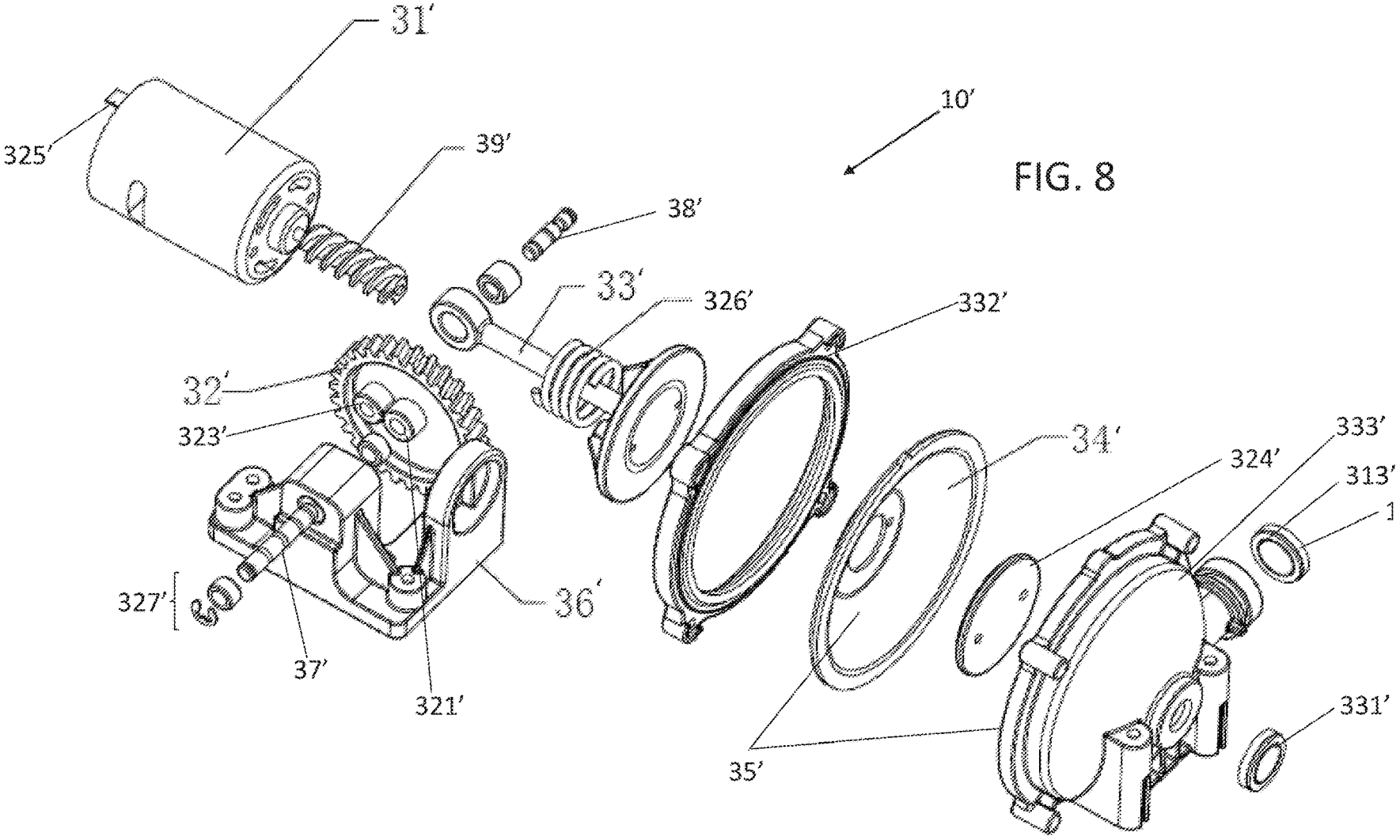
FIG. 8 is a perspective, exploded view of a high-pressure pump of a high and low-pressure integrated air pump in accordance with a second embodiment of the present disclosure.
Figure 9:
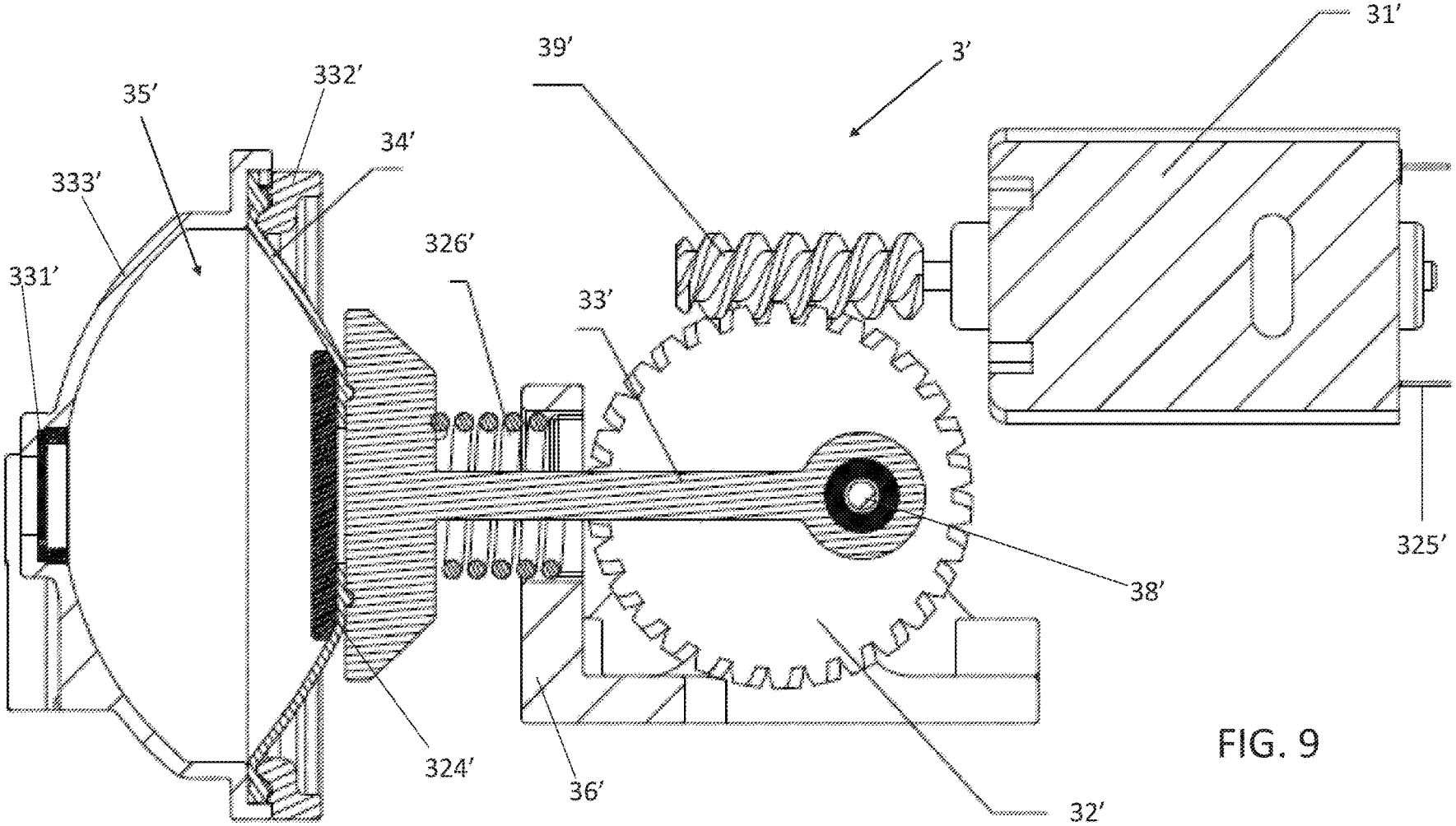
FIG. 9 is cross-sectional view of the high-pressure pump shown in FIG. 8.

An alternative arrangement for high-pressure pump 3 is shown in FIGS. 8 and 9 as high-pressure pump 3'. The second high-pressure pump 3' of FIGS. 8 and 9 is similar to the first high-pressure pump 3 of FIGS. 1-6, with like reference numerals indicating like elements, except as described below.

The second high-pressure pump 3' includes a diaphragm pump similar to high-pressure pump 3. However, rather than using a power transmission with spur gears, as described above with respect to gears 39 and 32, high-pressure pump 3' includes a helical gear transmission. The output shaft of motor 31' includes a worm gear 39' fixed thereto, which meshes with helical gear 32'. As worm gear 39' is driven to rotate by second motor 31', it drives rotation of helical gear 32'. The helical gear transmission of the present alternative embodiment may be larger in diameter than the spur gear transmission described above. The increase in size results in a speed reduction, which may reduce noise and vibration during use.

Still referring to FIGS. 8 and 9, a spring 326' is also provided between connecting rod 33' and gear base 36'. Connecting rod 33' compresses spring 326' during the return stroke of the reciprocating motion (i.e., the portion of the stroke during expansion of cavity 35'), such that the torque provided by second motor 31' tends to be balanced in the forward and return process of reciprocating motion, which can increase the service life of second motor 31' (e.g., by prolonging the life of the brushes where motor 31' is a brushed motor). During the forward stroke (i.e., the portion of the stroke during contraction of cavity 35'), the spring 326' and connecting rod 33' work together to compress cavity 35', which can reduce the peak power demand of second motor 31'.

Figure 6:
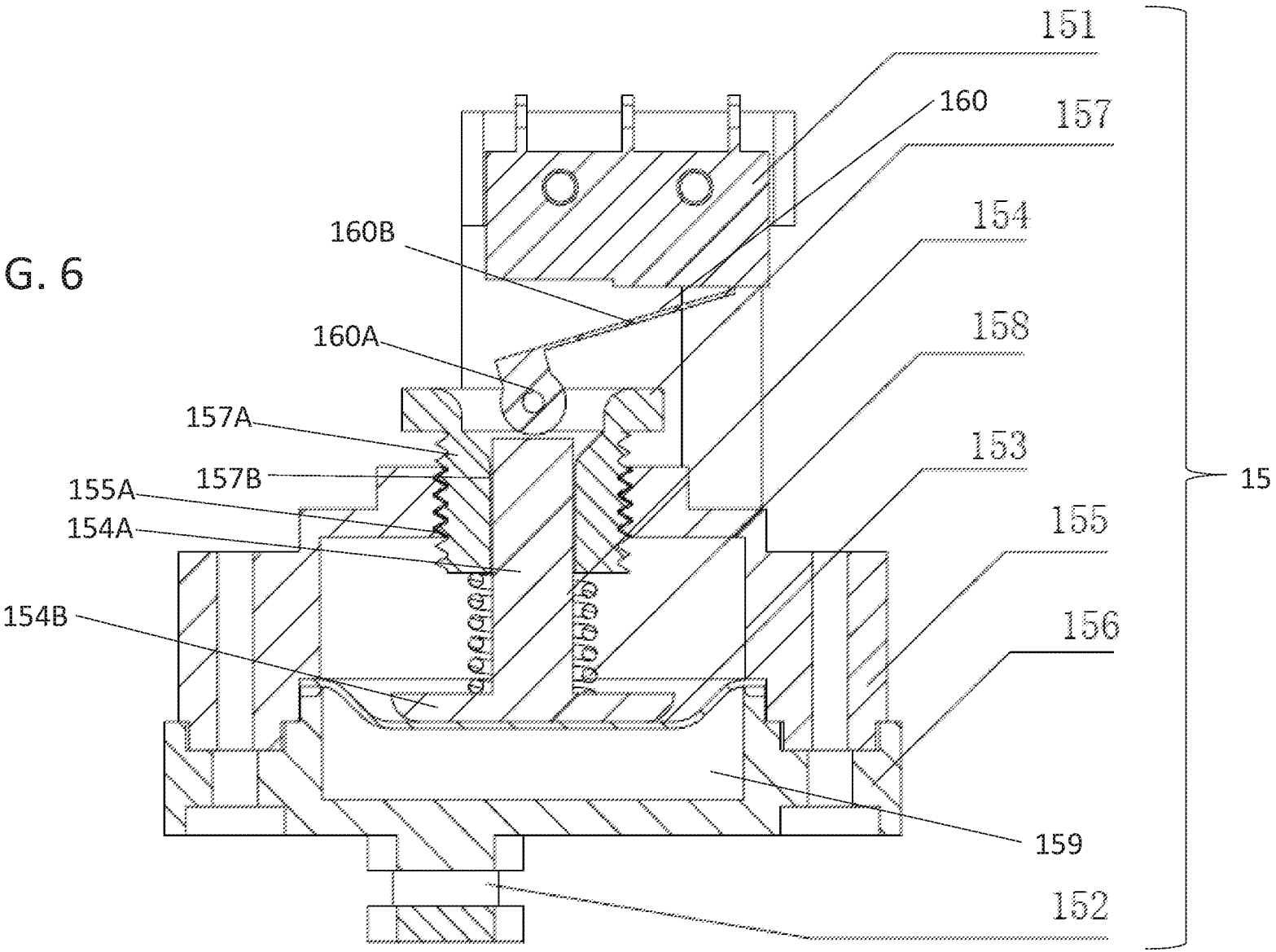
FIG. 6 is a cross-sectional view of a pressure valve of the high and low-pressure integrated air pump shown in FIG. 1.

Turning again to FIG. 1, integrated air pump 10 also includes pressure valve 15. As shown in FIG. 5 pressure valve 15 is disposed along airflow pathway 122, within volute 23. FIG. 6 shows a detailed view of pressure valve 15, includes signal switch 151, trigger 160, adjusting nut 157, valve core 154, spring 158, diaphragm 153, upper cover 155, lower cover 156, cavity 159, and air inlet 152. Signal switch 151 is an electrical switch which is suspended within pressure valve 15 by fasteners. Signal switch 151 includes a positive voltage terminal, a negative voltage terminal, and a ground, and is configured to activate and deactivate high-pressure pump 3 and/or low-pressure pump 2 when a pressure threshold is detected.

Trigger 160 is disposed below signal switch 151. Trigger 160 includes a hinge 160A and a stem 160B. Stem 160B extends laterally out from hinge 160A, and hinge 160A is rotatably fixed to valve core 154. Adjusting nut 157 includes throughbore 157B and threaded portion 157A. Throughbore 157B slidably receives valve core 154 and at a top end, widens out such that hinge 160A can freely rotate about its axis about 90 degrees. Threaded portion 157A is threadably engaged with upper cover 155 to coupled adjusting nut 157 to upper cover 155. Valve core 154 includes stem 154A and flange 154B. Stem 154A is partially slidably received within throughbore 157B and is coupled to hinge 160A at its end. Stem 154A extends below adjusting nut 157 and terminates at flange 154B. Flange 154B is a flat, round surface which extends laterally beyond the circumference of stem 154A. Spring 158 is engaged with and extends between stem 154A and adjusting nut 157 and biases valve core 154 away from adjusting nut 157. Upper cover 155 threadably receives adjusting nut within threaded bore 155A and extends laterally out from threaded bore 155A on both sides, then extends vertically down to engage with lower cover 156. Upper cover 155 and lower cover 156 combine to form cavity 159. Diaphragm 153 is disposed between the coupling of upper cover 155 and lower cover 156 and extends across cavity 159 to divide cavity 159 into two chambers. Diaphragm 153 is disposed below and supports stem 154A of valve core 154 such that diaphragm 153 holds valve core 154 up against the bias of spring 158. Air inlet 152 is disposed on lower cover 156 opposite upper cover 155. Air inlet 152 is an opening which allows air to flow into cavity 159.

As shown in FIG. 5, air inlet 152 of pressure valve 15 is provided along airflow pathway 122. As an inflatable product is inflated via low-pressure pump 2, the air pressure in the inflatable chamber increases. As the air pressure increases, the efficiency of low-pressure pump 2 will decrease. Once the air pressure inside the inflatable product matches the pump force of low-pressure pump 2, check valve 14 will close. The closing of check valve 14 and continuous pumping of low-pressure pump 2 will result in an increase in air pressure inside volute 23.

Because air inlet 152 of pressure valve 15 is open to volute 23, the air pressure also rises in chamber 159. The increase in air pressure in chamber 159 pushes diaphragm 153 up, which pushes valve core 154 up against the bias of spring 158. The spring constant of spring 158 is configured such that valve core 154 will move when the pressure capacity of low-pressure pump 3 has been reached or nearly reached (e.g., within 10% of the maximum pressure which can be developed by pump 2). Furthermore, adjusting nut 157 can be threaded up and down which changes the pretension force of spring 158. In this way, the spring pressure to be overcome when valve core 154 moves can be changed, thereby changing the pressure threshold set by pressure valve 15.

As valve core 154 slides up, trigger 160 moves closer to full contact with signal switch 151. When trigger 160 comes into full engagement with signal switch, signal switch 151 is signaled to output a signal to control circuit 150. Control circuit 150 is arranged to deactivate low-pressure pump 2 and activate the high-pressure pump 3 when the signal is received from switch 151. In this way, control circuit 150 cooperates with switch 151 to automatically engage the low-pressure portion of pump 10 when the pressure needed is correspondingly low, and then automatically disengage the low-pressure portion of pump 10 and automatically engage the high-pressure portion of pump 10 when higher pressure is needed to continue inflation.

Figure 7:
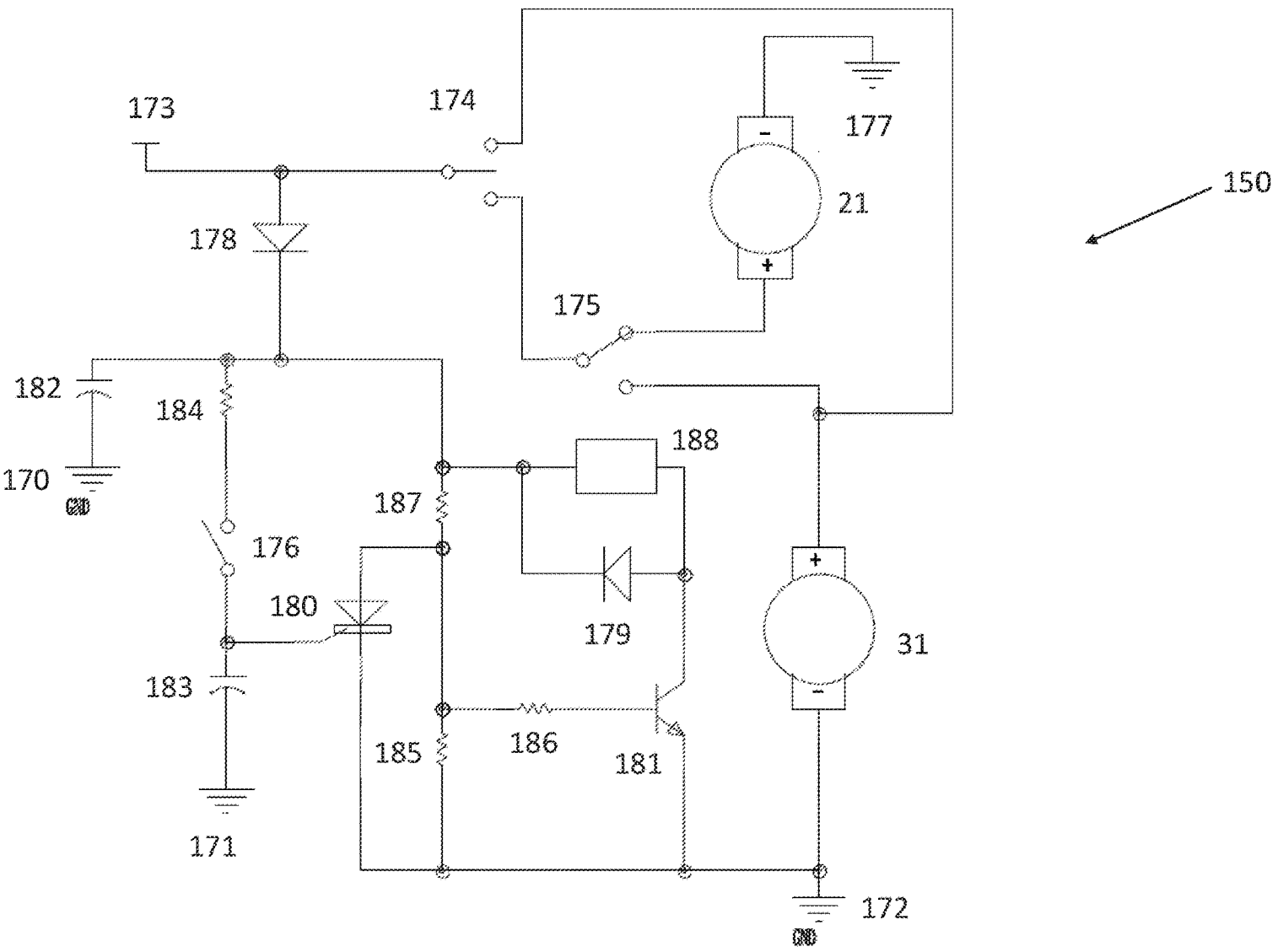
FIG. 7 is a schematic diagram of a control circuit made for a pump in accordance the present disclosure.

FIG. 7 shows one exemplary control circuit 150 which performs this automatic function. Therefore, the control circuit 150 includes a relay switch 175, with a first closed position which allows current to flow to motor 21 of low-pressure pump 2 (as shown in FIG. 7), and second closed position which allows current to flow to motor 31 of low-pressure pump 3. Thus switch 175 can provide power to one of motors 21, 31, but not both, ensuring that pump 10 will activate only one of the pumps 2, 3 at any one time.

Main power switch 174, which is connected to user-activated switch 167, determines whether 12V power from power source 173 may flow through switch 175 to either pump motor 21 or pump motor 31.

Circuit 150 further includes an arrangement of electrical components and connections designed to ensure reliable and safe operation of pump motors 21, 31 via switches 174, 175, including for high-power operation of high-pressure pump motor 31. These components and connections are shown in FIG. 7 with standard symbols and nomenclature which need not be explained in further detail here. The components and connections include ground connections 170, 171, 172 and 177, switch 176, diodes 178, 179 and 180, capacitors 182 and 183, resistors 184, 185, 186 and 187, semiconductor 181, and relay 188.

Circuit 150 may also be implemented through microcontrollers, computers or any other suitable electrical control modality.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An integrated air pump, comprising:

a housing open to atmosphere and including an air outlet;

a high-pressure pump disposed within the housing and in fluid communication with the air outlet, the high-pressure pump including a first motor, a transmission operably coupled to the first motor, and a movable member eccentrically coupled to the transmission assembly;

a first high-pressure check valve disposed between the high-pressure pump and atmosphere;

a second high-pressure check valve disposed between the high-pressure pump and the air outlet of the housing;

a low-pressure pump disposed within the housing and in fluid communication with the air outlet, the low-pressure pump comprising a second motor; and a low-pressure check valve disposed between the low-pressure pump and the air outlet of the housing, the low-pressure check valve disposed between the second high-pressure check valve and the air outlet.

2. The integrated air pump according to claim 1, wherein the low-pressure pump is a centrifugal pump including an impeller operably coupled to the second motor.

3. The integrated air pump according to claim 1, wherein the high-pressure pump further comprises a diaphragm operably coupled to the movable member.

4. The integrated air pump according to claim 1, wherein a longitudinal axis of the first motor is perpendicular to a longitudinal axis of the second motor.

5. The integrated air pump according to claim 1, wherein the housing further comprises an air inlet in fluid communication with the low-pressure pump and the high-pressure pump.

6. The integrated air pump according to claim 5, wherein the housing further comprises an exhaust vent configured to allow air to flow freely between the housing and atmosphere.

7. The integrated air pump according to claim 1, wherein the high-pressure pump is in fluid communication with the air outlet through a first outlet passageway, and wherein the low-pressure pump is in fluid communication with the air outlet through a second outlet passageway.

8. The integrated air pump according to claim 1, wherein, when the high-pressure pump is activated, the low-pressure check valve is closed.

9. The integrated air pump according to claim 1, wherein, when the low-pressure pump is activated, the second high-pressure check valve is closed.

10. The integrated air pump according to claim 1, further comprising a pressure sensor operably connected to the high-pressure pump and the low-pressure pump.

11. The integrated air pump according to claim 10, wherein the pressure sensor is configured to activate the low-pressure pump at a first pressure threshold and to activate the high-pressure pump at a second pressure threshold.

12. The integrated air pump according to claim 11, wherein the second pressure threshold is higher than the first pressure threshold.

13. The integrated air pump according to claim 10, wherein the pressure sensor is configured to deactivate the low-pressure pump at a pressure threshold and to activate the high-pressure pump at the pressure threshold.

14. The integrated air pump according to claim 1, wherein the transmission comprises a driving gear operably coupled to an output shaft of the first motor and a driven gear meshed with the driving gear, and wherein the movable member is eccentrically coupled to the driven gear.

15. The integrated air pump according to claim 14, wherein the driven gear is a worm gear.

16. The integrated air pump according to claim 1, further comprising a power supply operably connected to the first motor and the second motor.

17. The integrated air pump according to claim 16, wherein the power supply is a battery.

18. The integrated air pump according to claim 16, wherein the power supply is a power outlet.

19. An integrated air pump, comprising:

a housing open to atmosphere and including an air outlet;

a high-pressure pump disposed within the housing and in fluid communication with the air outlet, the high-pressure pump including a first motor, a transmission operably coupled to the first motor, and a movable member eccentrically coupled to the transmission assembly;

a first high-pressure check valve disposed between the high-pressure pump and atmosphere;

a second high-pressure check valve disposed between the high-pressure pump and the air outlet of the housing;

a low-pressure pump disposed within the housing and in fluid communication with the air outlet, the low-pressure pump comprising a second motor; and a low-pressure check valve disposed between the low-pressure pump and the air outlet of the housing, wherein an airflow from the second high-pressure check valve to the air outlet flows past the low-pressure check valve.

* * * * *